US009422135B2

(12) United States Patent
Rogers et al.

(10) Patent No.: US 9,422,135 B2
(45) Date of Patent: Aug. 23, 2016

(54) ELEVATOR DRIVE POWER SUPPLY CONTROL

(75) Inventors: Kyle W. Rogers, Farmington, CT (US); Daryl J. Marvin, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 504 days.

(21) Appl. No.: 14/111,272

(22) PCT Filed: Apr. 15, 2011

(86) PCT No.: PCT/US2011/032597

§ 371 (c)(1),
(2), (4) Date: Oct. 11, 2013

(87) PCT Pub. No.: WO2012/141713

PCT Pub. Date: Oct. 18, 2012

(65) Prior Publication Data

US 2014/0027210 A1 Jan. 30, 2014

(51) Int. Cl.

| | |
|---|---|
| ***B66B 1/34*** | (2006.01) |
| ***B66B 5/00*** | (2006.01) |
| ***B66B 13/22*** | (2006.01) |

(52) U.S. Cl.

CPC ..... *B66B 5/0031* (2013.01); *B66B 5/0018* (2013.01); *B66B 13/22* (2013.01)

(58) Field of Classification Search

CPC ..... B66B 5/0031; B66B 13/22; B66B 5/02; B66B 5/0018

USPC ..... 187/247, 316, 317, 391–393; 49/26, 28, 49/118; 318/280–286, 466–470

See application file for complete search history.

(56) References Cited

U.S. PATENT DOCUMENTS

| | | | |
|---|---|---|---|
| 4,898,263 | A | 2/1990 | Manske et al. |
| 5,020,640 | A | 6/1991 | Nederbragt |

(Continued)

FOREIGN PATENT DOCUMENTS

| | | |
|---|---|---|
| EP | 1037354 A1 | 9/2000 |
| EP | 0767133 B1 | 7/2002 |

(Continued)

OTHER PUBLICATIONS

International Preliminary Report on Patentability for International application No. PCT/US2011/032597 dated Oct. 24, 2013.

(Continued)

*Primary Examiner* — Anthony Salata
(74) *Attorney, Agent, or Firm* — Carlson, Gaskey & Olds

(57) ABSTRACT

An exemplary elevator control system includes an elevator drive. A safety chain is configured to monitor at least one condition of a selected elevator system component. A first switch is operable to interrupt power supply to the elevator drive. The first switch is controlled by the safety chain depending on the monitored condition. A second switch is in series with the first switch. The second switch is operable to interrupt power supply to the elevator drive. The second switch is controlled by the safety chain depending on the monitored condition. A monitoring device is configured to determine when the first and second switches should be in a power supplying condition for supplying power to the elevator drive. One such circumstance is when it is desirable to cause movement of the elevator car. The monitoring device determines that the first switch is in the power supplying condition for allowing the safety chain to control the second switch for supplying power to the elevator drive. The monitoring device determines whether the second switch is in a power supplying condition when the first switch is properly in the power supply condition. The monitoring device is configured to prevent the elevator drive from being powered whenever it determines that either the first switch or the second switch is not in a desired condition.

20 Claims, 2 Drawing Sheets

(56) References Cited

U.S. PATENT DOCUMENTS

| | | | | |
|---|---|---|---|---|
| 5,107,964 | A | 4/1992 | Coste et al. | |
| 5,549,179 | A | 8/1996 | Herkel et al. | |
| 5,765,664 | A | 6/1998 | Herkel et al. | |
| 6,446,760 | B1 | 9/2002 | Lisi | |
| 6,467,585 | B1 | 10/2002 | Gozzo et al. | |
| 6,550,585 | B2 | 4/2003 | Schoppa et al. | |
| 6,603,398 | B2 | 8/2003 | Tinone et al. | |
| 6,758,319 | B1 | 7/2004 | Lange et al. | |
| 7,176,653 | B2 | 2/2007 | Jahkonen | |
| 7,353,916 | B2 | 4/2008 | Angst | |
| 7,681,693 | B2 | 3/2010 | Tegtmeier et al. | |
| 7,775,327 | B2 | 8/2010 | Abraham et al. | |
| 7,896,135 | B2 | 3/2011 | Kattainen et al. | |
| 7,896,138 | B2 | 3/2011 | Syrman et al. | |
| 8,096,387 | B2 | 1/2012 | Kattainen et al. | |
| 8,490,755 | B2 | 7/2013 | Lindberg | |
| 8,820,482 | B2 * | 9/2014 | De Coi | B66B 5/0031 187/247 |
| 8,820,484 | B2 * | 9/2014 | Rui | B66B 1/32 187/288 |
| 8,941,964 | B2 * | 1/2015 | Madar | H02H 3/08 361/93.1 |
| 9,061,863 | B2 * | 6/2015 | Birrer | B66B 5/0031 |
| 9,128,155 | B2 * | 9/2015 | Xing | B66B 5/0087 |
| 9,309,090 | B2 * | 4/2016 | De Coi | B66B 5/0031 |
| 2007/0272491 | A1 | 11/2007 | Kattainen et al. | |
| 2007/0272492 | A1 | 11/2007 | Tegtmeier et al. | |
| 2008/0308360 | A1 | 12/2008 | Weinberger et al. | |
| 2009/0120725 | A1 | 5/2009 | Syrman et al. | |
| 2011/0048863 | A1 | 3/2011 | Schroeder-Brumloop et al. | |
| 2011/0094837 | A1 | 4/2011 | Gewinner et al. | |
| 2013/0271152 | A1 * | 10/2013 | Kattainen | G01R 31/28 324/537 |
| 2014/0231181 | A1 * | 8/2014 | Rogers | B66B 1/32 187/288 |
| 2015/0136531 | A1 * | 5/2015 | Rogers | B66B 1/30 187/290 |
| 2015/0166303 | A1 * | 6/2015 | Puranen | B66B 13/22 187/277 |
| 2015/0377968 | A1 * | 12/2015 | Lustenberger | B66B 5/0031 324/415 |

FOREIGN PATENT DOCUMENTS

| | | | |
|---|---|---|---|
| EP | 1444770 | B1 | 10/2008 |
| EP | 2326006 | A1 | 5/2011 |
| JP | 7-2472 | | 1/1995 |
| JP | 2002037545 | A | 2/2002 |
| JP | 2003081543 | A | 3/2003 |
| JP | 2007217097 | A | 8/2007 |
| JP | 2009046231 | A | 3/2009 |
| JP | 2010100427 | A | 5/2010 |

OTHER PUBLICATIONS

State Intellectual Property Office of People's Republic China, First Search for Application No. 201180070130.7 dated Apr. 23, 2014.

International Search Report and Written Opinion of the International Searching Authority for International Application No. PCT/US2011/055042 dated May 8, 2012.

International Search Report and Written Opinion of the International Searching Authority for International Application No. PCT/US2011/032597 dated Feb. 9, 2012.

Extended European Search Report for Application No. EP 11 86 3345 dated Sep. 22, 2014.

* cited by examiner

ELEVATOR DRIVE POWER SUPPLY CONTROL

BACKGROUND

Elevator systems include a variety of components for controlling movement of the elevator car. For example, an elevator drive is responsible for controlling the motor that causes movement of the elevator car. An elevator safety chain is associated with the elevator drive to prevent the motor from causing the elevator car to move if the elevator car doors or any of the doors along the hoistway are open, for example. The safety chain operates to prevent power flow to the drive and the motor.

Allowing the safety chain to control whether power is supplied to the elevator drive and the motor has typically been accomplished using high cost relays. Elevator codes require confirming proper operation of those relays. Therefore, relatively expensive, force guided relays are typically utilized for that purpose. The force guided relays are expensive and require significant space on drive circuit boards. Force guided relays are useful because they allow for monitoring relay actuation in a fail safe manner. They include two contacts, one of which is normally closed and the other of which is normally open. One of the contacts allows for the state of the other to be monitored, which fulfills the need for monitoring actuation of the relays.

Elevator system designers are always striving to reduce cost and space requirements. Force guided relays interfere with accomplishing both of those goals.

SUMMARY

An exemplary elevator control system includes an elevator drive. A safety chain is configured to monitor at least one condition of a selected elevator system component. A first switch is controlled by the safety chain for selectively providing power to the elevator drive depending on the monitored condition. A second switch is in series with the first switch. The second switch is controlled by the safety chain for selectively providing power to the elevator drive depending on the monitored condition. A monitoring device is configured to determine when the first and second switches should be in a power supplying condition for supplying power to the elevator drive. One such circumstance is when it is desirable to cause movement of the elevator car. The monitoring device determines that the first switch is in the power supplying condition before allowing the safety chain to control the second switch for supplying power to the elevator drive. The monitoring device determines whether the second switch is in a power supplying condition when the first switch is properly in the power supply condition. The monitoring device is configured to prevent the elevator drive from being powered whenever it determines that either the first switch or the second switch is not in a desired condition.

An exemplary method of controlling power supply to an elevator drive includes determining when first and second switches between a safety chain and a power connection to the elevator drive should be in a power supplying condition for supplying power to the elevator drive. A determination is made that the first switch is in the power supplying condition before allowing the second switch to be in the power supplying condition. A determination is made whether the second switch is in the power supplying condition when the first switch is properly in the power supplying condition. Power supply to the elevator drive is prevented if either the first switch or the second switch is not in a desired condition.

The various features and advantages of a disclosed example will become apparent to those skilled in the art from the following detailed description. The drawings that accompany the detailed description can be briefly described as follows.

DETAILED DESCRIPTION

Figure 1:
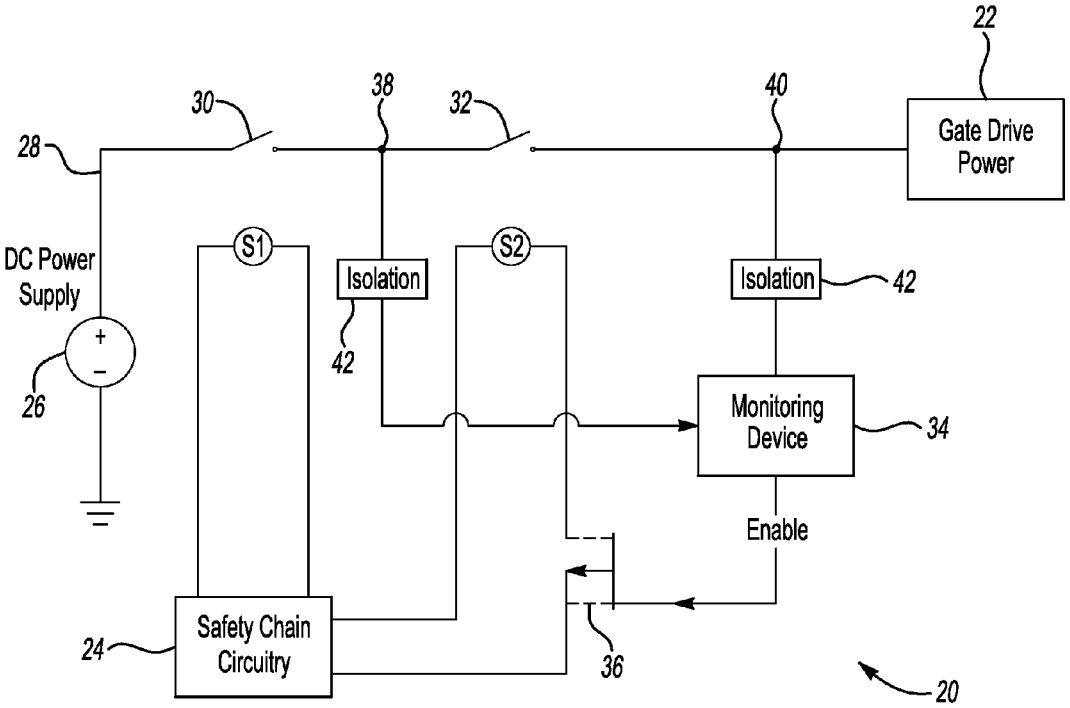
FIG. 1 schematically illustrates an example elevator power supply control system designed according to an embodiment of this invention.

FIG. 1 schematically shows an elevator control system 20. An elevator drive 22 controls operation of a motor (not illustrated) for controlling movement of an associated elevator car (not illustrated). A safety chain 24 selectively controls whether the elevator drive 22 receives power from a power supply 26. The safety chain 24 effectively controls whether a conductor 28 conducts power from the power supply 26 to the elevator drive 22.

The safety chain 24 is configured to monitor at least one condition of at least one selected elevator system component. In one example, the safety chain 24 comprises a plurality of switches associated with door locks along a hoistway. Whenever any of the door locks indicates that a hoistway door is open, the safety chain 24 is configured to prevent the elevator drive 22 from receiving power.

The safety chain 24 controls a first switch 30 for controlling whether power from the power supply 26 can flow along the conductor 28 to the elevator drive 22. The safety chain 24 also controls a second switch 32. When both of the first switch 30 and the second switch 32 are in a power supplying condition (i.e., closed), the elevator drive 22 can receive power from the power supply 26. The first switch 30 and the second switch 32 are separate from the inverter gate drive circuitry of the elevator drive 22.

In the illustrated example, the first switch 30 and the second switch 32 comprise independent relay switches. In one example, both switches are a single pole single throw (SPST) relay switch. In another example, the first switch 30 and the second switch 32 each comprise a single pole double throw (SPDT) relay switch. Other examples include semiconductor type switches.

The first switch 30 and the second switch 32 do not provide a self-monitoring function. The example of FIG. 1 includes a monitoring device 34 that is configured to determine whether the first switch 30 and the second switch 32 are appropriately actuated based upon the current condition of the associated elevator system. In one example, the monitoring device 34 comprises a microprocessor. The monitoring device 34 is programmed with software or firmware, for example, to determine when the first switch 30 and the second switch 32 should be in the power supplying condition. In another example, the monitoring device 34 comprises an ASIC that is configured to make the determinations regarding the condition of the switches. Another example monitoring device comprises discrete logic elements.

The monitoring device 34 is configured to determine whether the first switch 30 and the second switch 32 should be in the power supplying condition. If so, the monitoring device 34 utilizes a control component 36 (e.g., a solid state switch) to control a timing with which the first switch 30 and the second switch 32 are actuated by the safety chain 24. The monitoring device 34 delays actuation of the second switch 32 until after the monitoring device 34 is able to confirm that the first switch 30 is appropriately in the power supplying condition. The monitoring device 34 then allows for the second switch 32 to be actuated by the safety chain 24 and confirms that it is appropriately in the power supplying condition under corresponding circumstances.

In the illustrated example, the monitoring device 34 monitors a voltage on the conductor 28 at an output of the first switch 30 between the first switch 30 and the elevator drive 22 as schematically shown at 38. The voltage at the output of the first switch 30 (e.g., on the conductor 28 at 38) indicates whether the first switch 30 is in the power supplying condition. The second switch 32 is not allowed to be in a power supplying condition while the monitoring device 34 is determining whether the first switch 30 is in the power supplying condition to avoid a false positive determination regarding the condition of the first switch 30. In one example, the monitoring device 34 also determines whether the second switch 32 has an appropriate voltage at the same time.

Once the proper actuation of the first switch 30 is confirmed, the monitoring device 34 allows the safety chain 24 to actuate the second switch 32. The monitoring device 34 determines a voltage on a portion of the conductor 28 between the second switch 32 and the elevator drive 22 as schematically shown at 40. In other words, the monitoring device 34 determines whether the voltage at the output of the second switch 32 indicates the desired switch condition. This allows the monitoring device 34 to determine the actuation state of the second switch 32.

The monitoring device 34 in the illustrated example comprises a microprocessor and, therefore, isolation elements 42 are provided to protect the monitoring device 34 in the event of a high voltage condition on the conductor 28.

Figure 2:
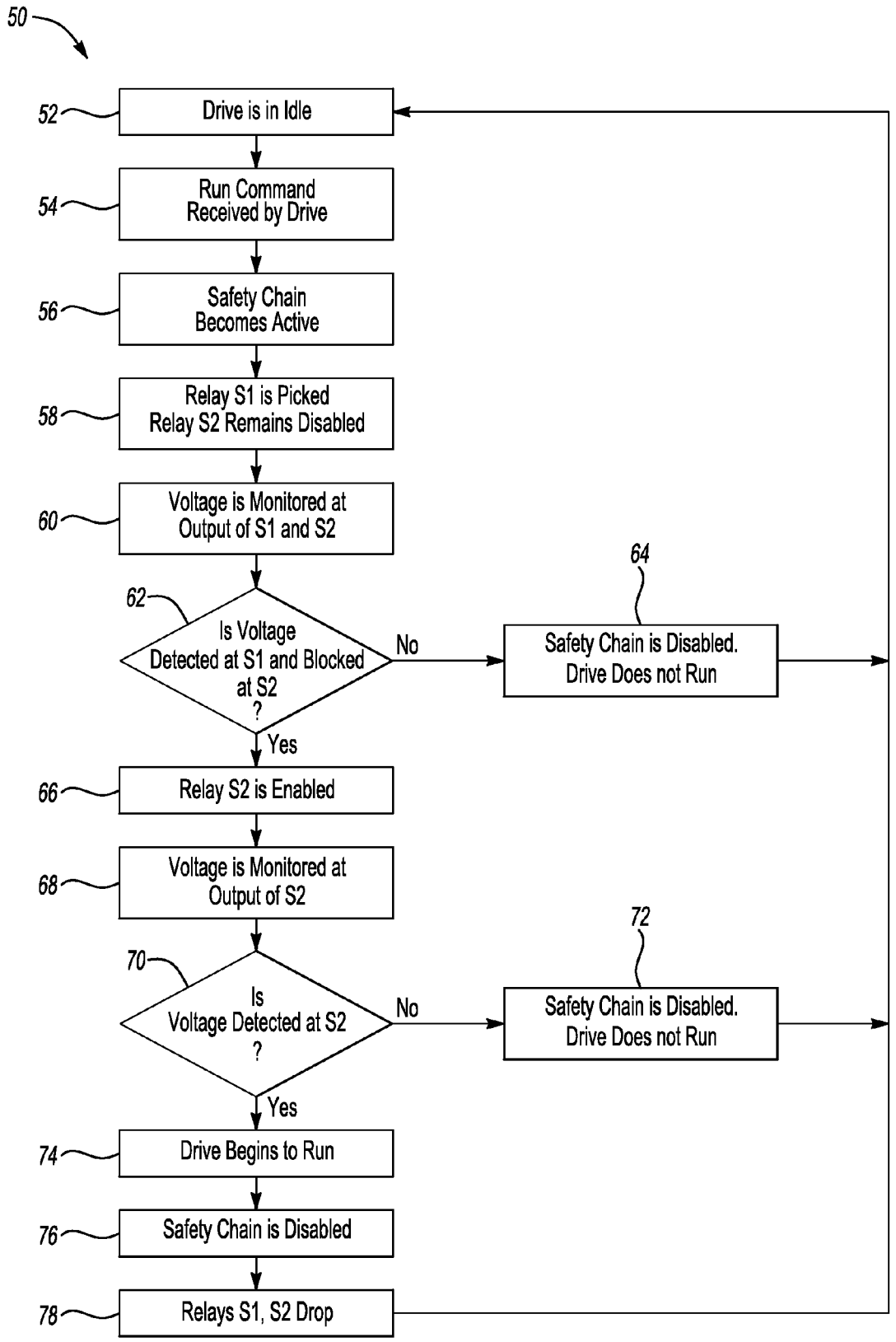
FIG. 2 is a flowchart diagram summarizing an example control approach.

FIG. 2 includes a flowchart diagram 50 that summarizes an example approach. At 52, the elevator system is in an operating condition in which the elevator drive 22 is idle. This corresponds to, for example, a condition in which the elevator car has stopped at a landing to allow passengers to board the elevator car. In this condition, the switches 30 and 32 are open, which opens the DC power supply to the inverter gate drive circuitry of the elevator drive 22. At 54, the elevator drive 22 receives a run command indicating that the elevator car should move. At 56, the safety chain 24 becomes active and attempts to actuate the first switch 30 and the second switch 32 (e.g., to close them) to allow power from the power supply 26 to be provided along the conductor 28 to the elevator drive 22.

As shown at 58, the monitoring device 34 allows for the first switch 30 to be actuated but prevents the second switch 32 from being actuated. The monitoring device 34 controls the switch 36 for this purpose, for example. At 60, the monitoring device 34 determines the voltage at the output of the first switch 30 and the second switch 32 (e.g., determines a voltage at the locations 38 and 40 in FIG. 1).

At 62, a determination is made whether the voltages detected at 38 and 40 indicate that the first switch 30 is in the power supplying condition and the second switch 32 is not in the power supply condition. If both of those conditions are not satisfied, the safety chain 24 is disabled at 64 and the elevator drive 22 does not receive power so that the commanded run does not occur. In other words, the elevator car is prevented from moving if the first switch 30 and the second switch 32 are not operating in a manner consistent with a desired operation of those switches.

Assuming that the determination at 62 is favorable, the monitoring device 34 allows for the second switch 32 to be actuated at 66. There is a delay between the steps 56 and 66. That delay is controlled by the monitoring device 34 to allow for verifying that the first switch 30 is functioning properly. At 68, the monitoring device 34 determines the voltage at the output of the second switch 32 (e.g., at 40 in FIG. 1).

At 70, a determination is made whether the voltage detected in step 68 is consistent with an expected voltage if the second switch 32 is properly in the power supplying condition. If not, the safety chain is disabled at 72 and the elevator drive 22 will not be able to control the motor for moving the elevator car.

Assuming that the determination made at 70 is positive, the elevator drive 22 receives power at 74 and the car moves as desired. At 76, the elevator car has stopped and the doors have opened to allow the passengers to exit the elevator car. At that point, the safety chain 24 is disabled because it has detected that the doors are open. When the safety chain is disabled at 76, the first switch 30 and the second switch 32 open at 78 so that no further power may be provided to the elevator drive 22 from the power supply 26, which prevents further movement of the elevator car until the safety chain 24 later actuates the first switch 30 and second switch 32 to move them into the power supplying condition in a manner consistent with that described above.

The disclosed technique of delaying actuation of one of the switches 30, 32 until proper operation of the other has been confirmed allows for testing both switches at the beginning of each elevator run. The disclosed technique does not leave any failure condition of either switch 30, 32 or the control component 36 undetected. Additionally, the control component 36 does not have any effect on the safety chain 24 disabling either the first switch 30 or the second switch 32. Therefore, the illustrated example maintains the necessary integrity of the system 20 while still allowing for monitoring the actuation state of the first switch 30 and the second switch 32, respectively.

The illustrated example allows for realizing the necessary monitoring functions to satisfy elevator codes regarding the control over supplying power to an elevator drive. The illustrated example accomplishes that goal without requiring expensive components such as force controlled relay switches. Instead, relatively inexpensive SPST or SPDT relays can be used in conjunction with the monitoring device 34. This saves cost and circuit board space.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator control system, comprising:

an elevator drive;

a safety chain configured to monitor at least one condition of a selected elevator system component;

a first switch that is operable to interrupt power supply to the elevator drive, the first switch being controlled by the safety chain depending on the monitored condition;

a second switch in series with the first switch, the second switch being operable to interrupt power supply to the elevator drive, the second switch being controlled by the safety chain depending on the monitored condition; and a monitoring device configured to determine when the first and second switches should be in a power supplying condition for supplying power to the elevator drive, determine that the first switch is in the power supplying condition before allowing the safety chain to control the second switch for supplying power to the elevator drive, determine whether the second switch is in a power supplying condition when the first switch is in the power supplying condition, and prevent the elevator drive from being powered responsive to determining that either the first switch or the second switch is not in a desired condition.

2. The system of claim 1, wherein the first and second switches each comprise one of a single pole single throw relay switch or a single pole double throw relay switch.

3. The system of claim 1, wherein the first and second switches each comprise a semiconductor type switch.

4. The system of claim 1, comprising a coupling between the safety chain and the second switch; and a control component that selectively interrupts the coupling responsive to the monitoring device to allow the monitoring device to control whether the safety chain controls the second switch.

5. The system of claim 4, wherein the control component comprise a switch.

6. The system of claim 1, wherein the monitoring device determines that the first switch is in the power supplying condition by determining a voltage level associated with an output of the first switch between the first switch and the elevator drive.

7. The system of claim 1, wherein the monitoring device determines that the second switch is in the power supplying condition by determining a voltage level associated with an output of the secured switch between the second switch and the elevator drive.

8. The system of claim 1, wherein the monitoring device comprises at least one of a microprocessor, an ASIC or discrete logic elements.

9. The system of claim 1, wherein the monitoring device prevents the safety chain from controlling the second switch until the monitoring device determines that the first switch is in the power supplying condition when both of the switches should be in the power supplying condition and wherein the monitoring device subsequently enables the second switch to be placed into the power supplying condition when the first switch is already in the power supplying condition.

10. The system of claim 1, wherein the safety chain is disabled responsive to the monitoring device determining that either the first switch or the second switch is not in the power supplying condition when the first and second switches both should be in the power supplying condition.

11. A method of controlling power supply to an elevator drive, comprising the steps of:

determining when first and second switches between a safety chain and a power connection to the elevator drive should be in a power supplying condition for supplying power to the elevator drive;

determining that the first switch is in the power supplying condition before allowing the second switch to be in the power supplying condition; and determining whether the second switch is in the power supplying condition when the first switch is in the power supplying condition; and preventing power supply to the elevator drive if either the first switch or the second switch is not in a desired condition.

12. The method of claim 11, wherein the first and second switches should be in the power supplying condition when an associated elevator car should move.

13. The method of claim 11, wherein determining whether the first switch is in the power supplying condition comprises determining a voltage level associated with an output of the first switch between the first switch and the elevator drive.

14. The method of claim 11, wherein the determining whether the second switch is in the power supplying condition comprises determining a voltage level associated with an output of the second switch between the second switch and the elevator drive.

15. The method of claim 11, wherein preventing power supply to the elevator drive comprises disabling the safety chain.

16. The method of claim 11, comprising delaying an actuation of the second switch until after the first switch is determined to be in the power supplying condition.

17. The method of claim 16, comprising preventing the safety chain from controlling the second switch until after determining that the first switch is in the power supplying condition when both of the switches should be in the power supplying condition; and subsequently enabling the second switch to be placed into the power supplying condition when the first switch is already in the power supplying condition.

18. The method of claim 11, wherein the first and second switches each comprise a single pole single throw relay switch or a single pole double throw relay switch.

19. The method of claim 11, wherein the first and second switches each comprise a semiconductor type switch.

20. The method of claim 11, comprising interrupting a coupling between the safety chain and the second switch until the first switch is determined to be in the power supplying condition.

* * * * *